US006364705B1

(12) United States Patent
Yamamoto

(10) Patent No.: US 6,364,705 B1
(45) Date of Patent: Apr. 2, 2002

(54) CONNECTOR INCLUDING A RELEASABLE CONTACT ENGAGING LATCH

(75) Inventor: Masahiro Yamamoto, Yokohama-Pref (JP)

(73) Assignee: Tyco Electronics Logistics AG, Steinach (CH)

( * ) Notice: Subject to any disclaimer, the term of this patent is extended or adjusted under 35 U.S.C. 154(b) by 0 days.

(21) Appl. No.: 09/553,497

(22) Filed: Apr. 20, 2000

(30) Foreign Application Priority Data

Jul. 26, 1999 (JP) ..... 11-210820

(51) Int. Cl.[7] ..... H01R 13/40
(52) U.S. Cl. ..... 439/595
(58) Field of Search ..... 439/595, 752

(56) References Cited

U.S. PATENT DOCUMENTS 5,071,373 A * 12/1991 Nagasaka et al. ..... 439/595
5,554,051 A * 9/1996 Shinji et al. ..... 439/595
5,630,733 A * 5/1997 Jinno et al. ..... 439/595
5,672,075 A 9/1997 Maejima ..... 439/752
5,730,626 A * 3/1998 Tomita et al. ..... 439/595
5,830,013 A * 11/1998 Saito et al. ..... 439/595
5,839,921 A 11/1998 Yamanashi ..... 439/595

FOREIGN PATENT DOCUMENTS

EP 0 827 236 A1 3/1998

* cited by examiner

*Primary Examiner*—Renee Luebke
*Assistant Examiner*—Briggitte R. Hammond
(74) *Attorney, Agent, or Firm*—Hoffmann & Baron, LLP

(57) ABSTRACT

A connector has a slot formed in a housing to accommodate a terminal and a lance disposed in the slot to engage with and latch the terminal inserted into a slot. A curved surface is formed on a part of the terminal which is in contact with the lance so that the terminal is released by applying a predetermined external force to the terminal in a temporary latch state where the terminal is temporarily latched by the lance. The external force may be applied to the terminal by a tool.

5 Claims, 6 Drawing Sheets

CONNECTOR INCLUDING A RELEASABLE CONTACT ENGAGING LATCH

FIELD OF THE INVENTION

The present device relates to a connector which is configured to facilitate the release of a terminal accommodated in a housing, and in more detail, to a connector which is configured to facilitate the release of a terminal by contriving shapes of a lance which latches a terminal in a housing and a terminal which is in contact with the lance.

BACKGROUND OF THE INVENTION

A conventional connector of this kind comprises slots 12 which are disposed in a housing 10 to receive terminals 1, and a pair of lances 11' which are disposed in the slots to engage with and latch (primary latch) terminals inserted into the slots as shown in FIG. 12. In the primary latch state, the terminals are temporarily latched by engaging steps formed at ends of the lances with rear portions of the terminals (a state shown in FIG. 12). When it is confirmed that the terminals are inserted in normal positions and normal directions, the terminals are set in a secondary or final latch state by separate means.

When the terminal is to be released from the lance in the primary latch state, the conventional connector requires that the lance should be pried with a terminal extracting tool 20' which is inserted into an engaging part between the lance and the terminal in a direction reversed to an insertion direction of the terminal as shown in FIG. 12.

Since the conventional connector requires inserting the extracting tool into the housing, it is necessary to provide in the slot 12 a space for inserting the extracting tool. Accordingly, the conventional connector must include a pitch width which is rather large between adjacent terminals and has a large size when it comprises a large number of terminals. That is to say, the conventional connector can hardly be configured as a compact connector which comprises a large number of terminals arranged at a high density.

Furthermore, when the terminal is inserted inadequately in the primary latch state, it is necessary to release the terminal from the slot, but the conventional connector requires tedious procedures to release the terminal by the releasing method described above, thereby lowering a working efficiency and often causing a contact (contact spring) to be damaged by the extracting tool.

SUMMARY OF THE INVENTION

In order to solve the problems described above, the present invention provides a connector comprising a housing which has slots for accommodating terminals and lances which are disposed in the slots to engage with and latch the terminals inserted into the slots. A portion of the terminal which is to be brought into contact with the lance is shaped into a curved surface so that the terminal is released from the lance by applying a predetermined external force to the terminal in a direction reversed to an insertion direction of the terminal while the terminal is temporarily latched by the lance. The predetermined external force maybe applied to the terminal by a tool.

DETAILED DESCRIPTION OF THE PREFERRED EMBODIMENT

Figure 1:
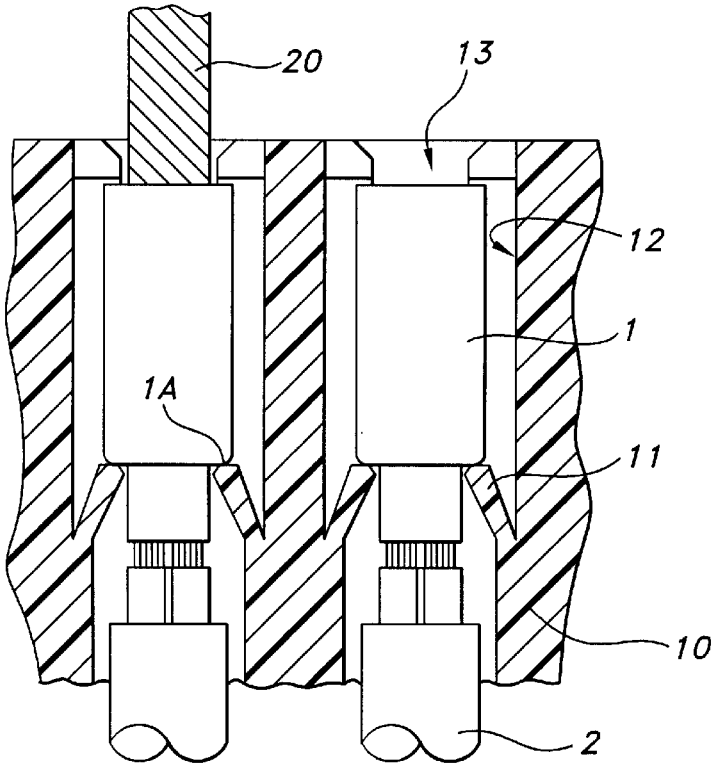
FIG. 1 is a longitudinal section view showing a first embodiment of the connector according to the present invention.

Hereinafter, the device will be explained based on the embodiments shown in the drawings. FIG. 1 shows an embodiment of the connector according to the present invention. The connector preferred as the embodiment shown in FIG. 1 accommodates terminals 1 in slots 12 which are disposed in a housing 10. Shown as the terminal is a receptacle type (female type) contact terminating with a wire material 2. This terminal (female type) is connected to a male type contact (round pin) (not shown) which is inserted in the direction reversed to the insertion direction of the terminal (female type).

Disposed in the slots are lances 11 which are to engage with the latch the inserted terminals. Though a pair of lances are disposed in the embodiment shown in FIG. 1, the number of the lances is not limited. Only one lance may be disposed.

The terminal is inserted upward from a bottom of FIG. 1. The terminal which is inserted into the slot engages at a rear surface thereof (constricted portion) with a tip of the lance.

Figure 2:
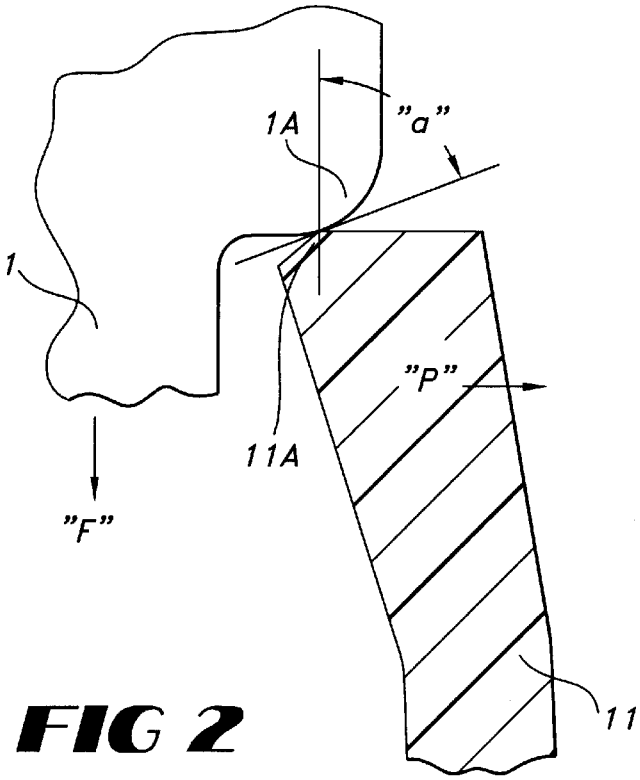
FIG. 2 is an enlarged view showing main members of the first embodiment.
Figure 12:
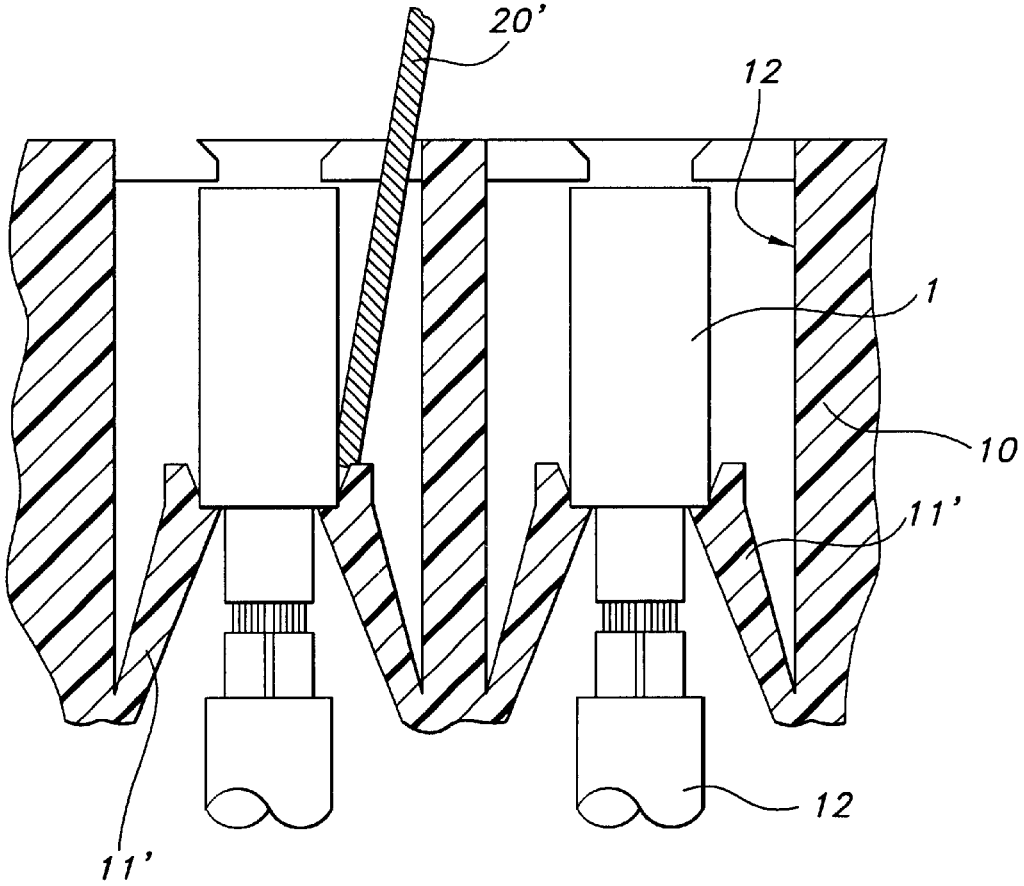
FIG 12 (PRIOR ART)
FIG. 12 is a longitudinal sectional view showing a conventional connector.

The lance has a tip shape which is shown in detail in FIG. 2. In this drawing, the lance is in a primary latch state where it temporarily latches the terminal and is in contact with a curved surface (rounded portion) formed on a rear of the terminal. Different from the conventional example shown in FIG. 12, the embodiment shown in the drawing has, in place of the step, a chamfer 11A which is formed at an inside corner of the tip. In addition, a shape of the lance which serves as a spring is not limited so far as it allows the terminal to pass elastically therethrough when the terminal is inserted into the housing.

When it is confirmed that the terminal has been inserted in a normal position and a normal direction in the primary latch state, it is set in a secondary latch (final lock) state. A sustaining plate disclosed by Japanese Patent Application Laid-Open No. 9-115584, for example, is available as secondary latch means. The sustaining plate serves to prevent the wire material of the terminal from coming off the connector after the terminal, which terminates with the wire material, is inserted through a through-hole formed in a body of the sustaining plate and then the body is slid in a direction intersecting with the insertion direction of the terminal so that the through-hole engages with the wire material of the terminal.

When the terminal is inserted in an incorrect position or an incorrect direction in the primary latch state, the terminal can be released from the lance by applying a predetermined external force in a direction reversed to the insertion direction of the terminal (for example, with a tool described later).

To release the lance from the terminal, the external force is applied to the terminal. The external force applied to the terminal must be stronger than a retaining force of the lance which is determined by a contact angle with the terminal, a shape and a material or rigidity of the lance. When the external force is applied to the terminal in the primary latch state, the lance slides along the curved surface of the terminal (while changing the contact angle), has a minimum contact angle just before release from the terminal and is released from the terminal when the lance slides beyond the curved surface.

Figure 3:
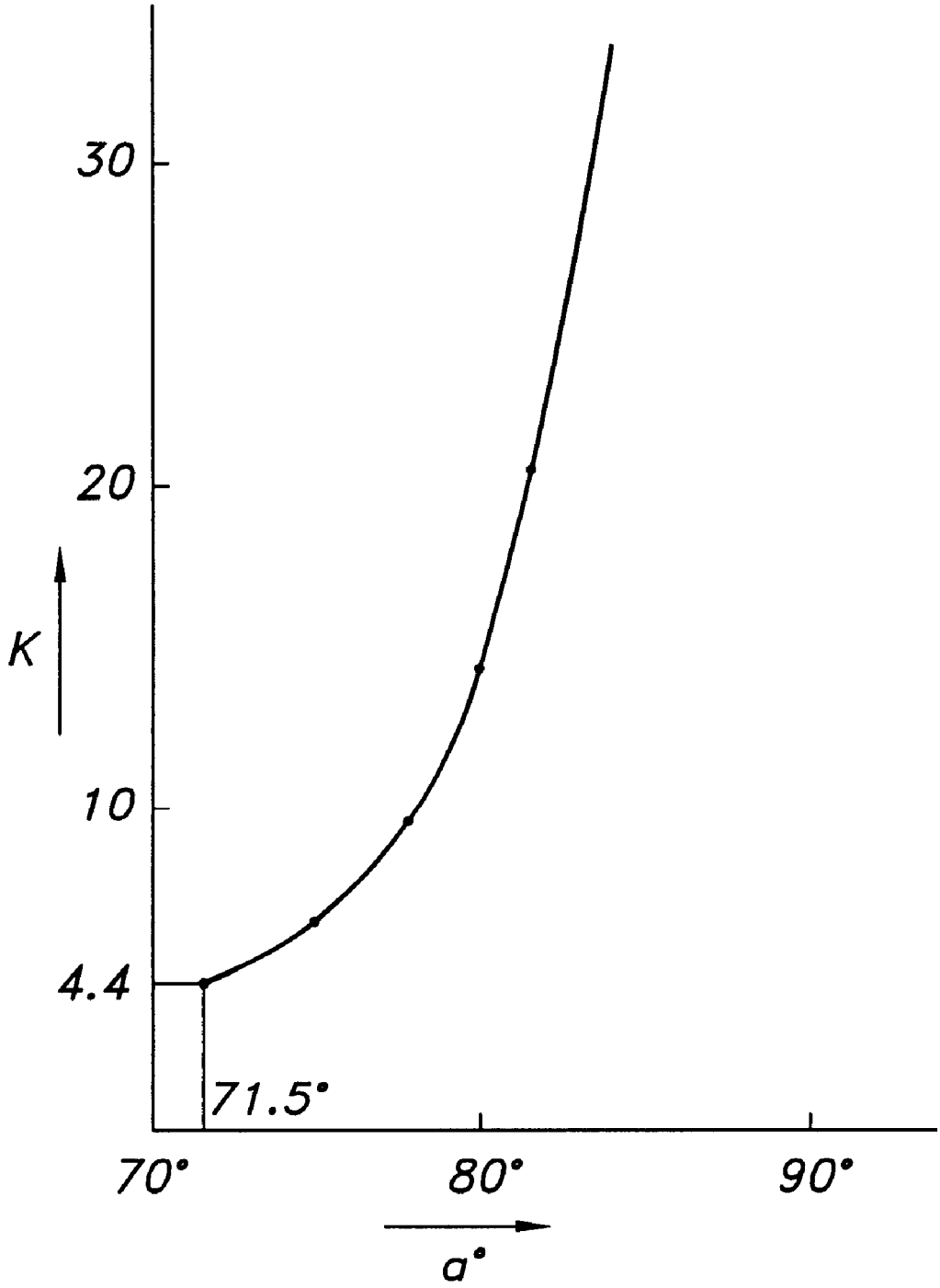
FIG. 3 is a graph showing relationship between a retaining force and a contact angle of a lance.

FIG. 3 shows relationship between a retaining force and a contact angle of the lance which has a definite shape and is made of a defined material. In FIG. 3, an ordinate is expressed in a coefficient.

When the contact angle is represented by $\alpha$, a retaining force produced on the basis of a spring force of the lance (only one lance is considered for simplicity though the embodiment shown in the drawing has a pair of lances) is designated by P, the coefficient expressed by the ordinate of FIG. 3 is designated by K, a coefficient of friction of the terminal (metal) relative to the lance (plastic) is represented by $\mu$ and an angle of the lance relative to the terminal is designated by $\rho$, an external force F to be applied to the terminal can be calculated by an equation shown below. The retaining force of the lance and the external force are exerted in directions shown in FIG. 2.

$$F=PK=P\tan(\alpha+\rho),$$

wherein $\rho=\tan-1\ \mu$.

In FIG. 1, a reference numeral 20 represents a tool which is used to release the terminal from the lance by applying the external force. Since the terminal is a receptacle contact in the embodiment shown in the drawing, a through-hole is formed in the housing to insert a male type contact into the terminal (female type) in a direction reverse to the insertion direction of the terminal. The tool which is used to apply the external force to the terminal may be inserted through this through-hole 13.

Figure 4:
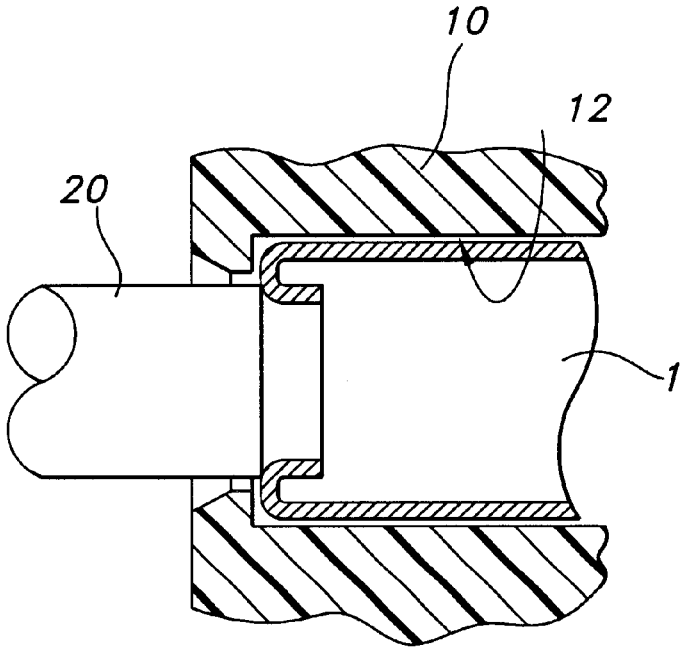
FIG. 4 is longitudinal sectional view showing a portion of a second embodiment of the connector according to the present invention.

FIG. 4 shows a second embodiment of the present invention wherein a round type terminal (having a terminal body configured as a cylindrical receptacle contact having a ferrule formed at a tip) is released from a lance (not shown) by pushing the terminal with a round type tool.

In case of the embodiment shown in FIG. 4, the terminal has a narrow area to be brought into contact and pushed with the tool, whereby unnecessary force is applied to a contact portion and the terminal may be damaged when the terminal is pushed with the tool which is not brought into sufficient contact with the terminal.

Figure 5:
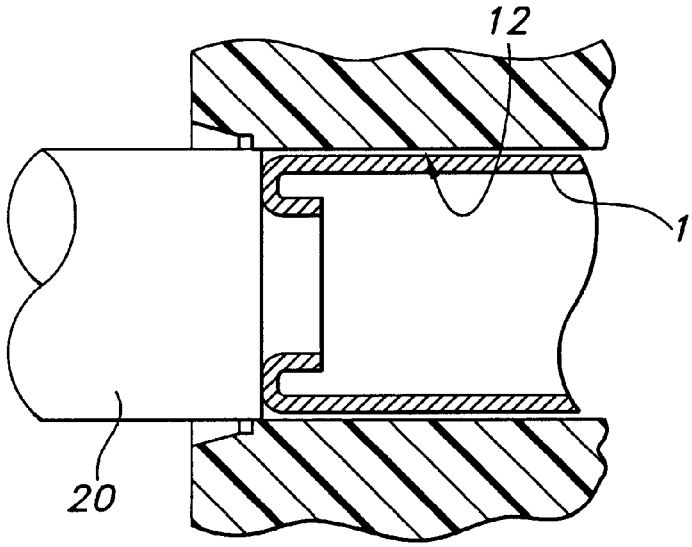
FIG. 5 is a longitudinal section view showing a portion of a third embodiment of the connector according to the present invention.
Figure 6:
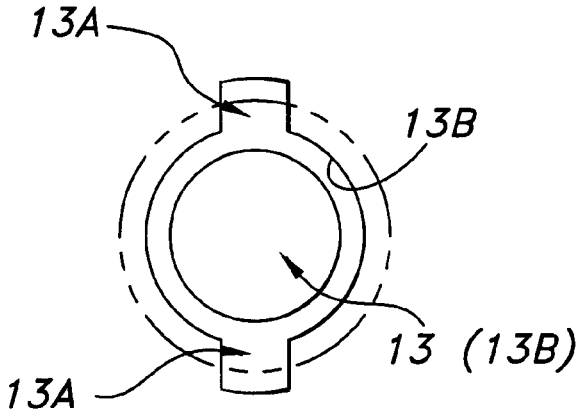
FIG. 6 is a side view of the third embodiment shown in FIG. 4.
Figure 7:
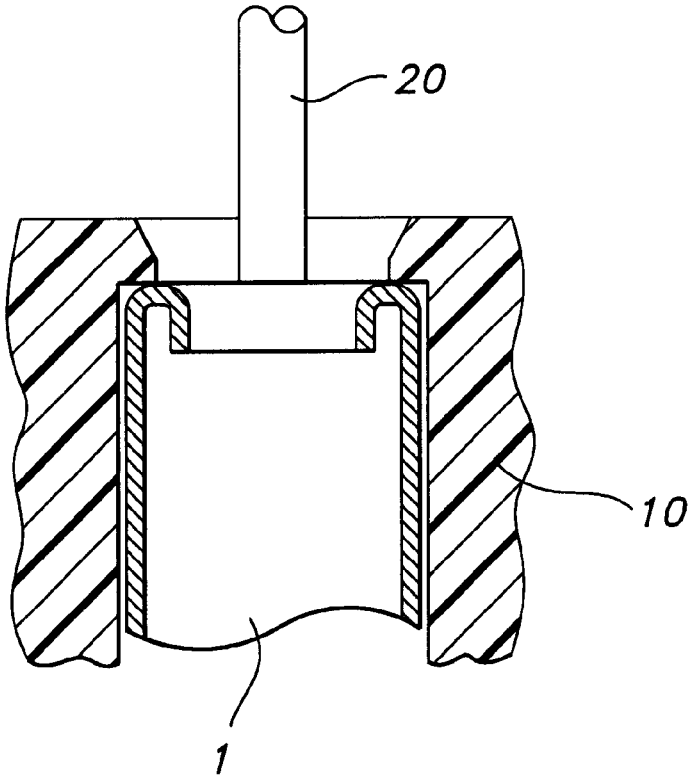
FIG. 7 is a cross sectional view of the third embodiment shown in FIG. 4.
Figure 8:
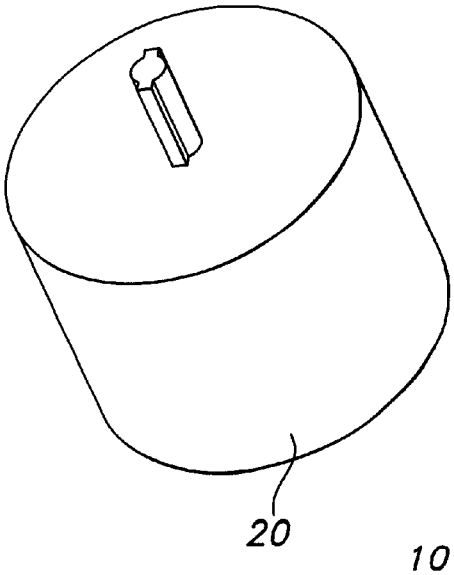
FIG. 8 is a perspective view of a tool used in the third embodiment.
Figure 9:
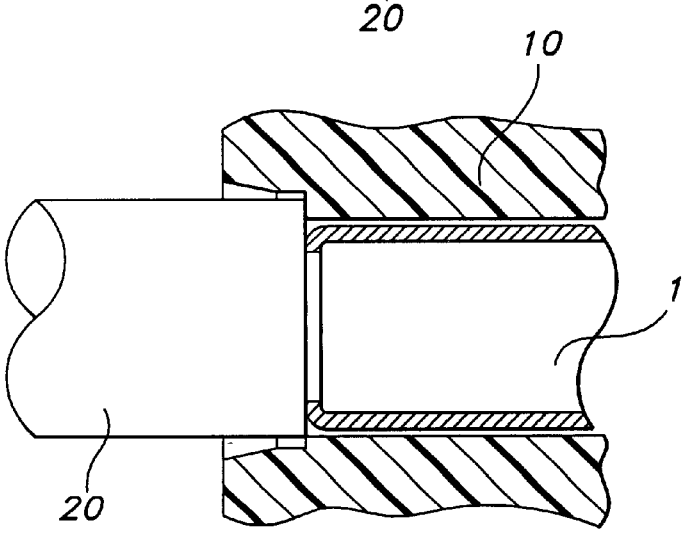
FIG. 9 is a longitudinal sectional view showing a portion of a fourth embodiment of the connector according to the present invention.
Figure 10:
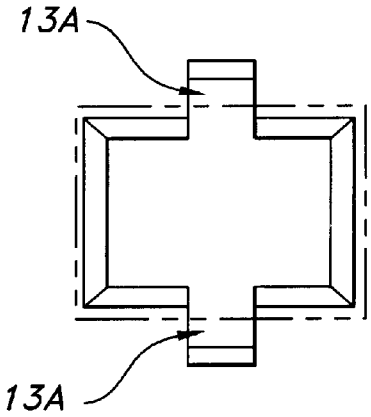
FIG. 10 is a side view of the fourth embodiment shown in FIG. 9.
Figure 11:
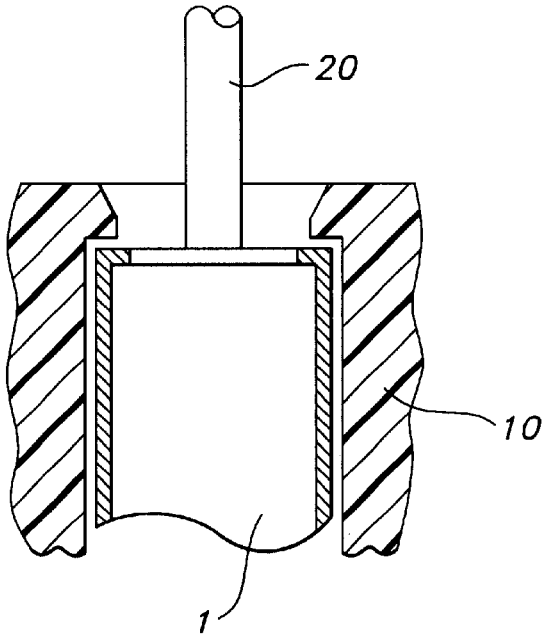
FIG. 11 is a cross sectional view of the fourth embodiment shown in FIG. 9.

FIGS. 5 through 7 show a third embodiment of the present invention wherein a planar type tool is used for a round type terminal. FIG. 5 is a longitudinal sectional view, FIG. 6 is a side view (the tool not shown) and FIG. 7 is a cross sectional view. Furthermore, FIGS. 9 through 11 show a fourth embodiment of the present invention wherein a planar type tool is used for a rectangular terminal. These embodiments provide sufficient areas of the terminals to be pushed with a tool. FIG. 8 exemplifies a tool 20 which is to be used in the third embodiment. In addition, a blade type screwdriver, for example, may be used as a tool.

In the third embodiment shown in FIGS. 5 through 7, a pair of grooves 13A for receiving the tool are formed in inside wall surfaces opposed to each other of an opening 13 of a slot 12 in which the terminal is accommodated. FIGS. 5 and 7 show a condition where the tool is inserted into the grooves 13A. In FIG. 6, a circle inside the opening of the terminal slot indicates an inside diameter of the terminal (receptacle contact) (inside diameter of the ferrule) and a dashed line outside the opening indicates an outside diameter of the terminal. In FIG. 6, a reference numeral 13B represents a through-hole formed as a portion of the opening for passing a male type (round type) pin which is inserted into the terminal for connection thereto and a reference numeral 13*b* designates an inside wall surface of the through-hole.

Also in the fourth embodiment shown in FIGS. 9 though 11 wherein a terminal, a terminal slot and an open have rectangular sectional shapes, grooves 13A for receiving a tool are formed in inside wall surfaces opposed to each other of an opening 13 of a slot 12 which accommodates the terminal as in the third embodiment.

The connector according to the present invention therefore provides a curved surface which is formed on a part of a terminal to be brought into contact with a lance. This allows the terminal to be released from the lance when a predetermined external force is applied to the terminal. The connector allows the terminal to be released simply by pushing a main body of the terminal with a tool such as a screwdriver, for example, which is inserted through an opening formed in the vicinity of an open end portion of the terminal and requires, unlike the conventional connector, reserving no space for inserting the tool into the terminal slot. Accordingly, the connector according to the present invention can have a short distance (pitch width) between adjacent terminals, thereby being configured as a compact connector which has a large numbers of terminals arranged at a high density.

Furthermore, the connector according to the present invention does not require inserting the tool deep into a housing to prize the lance, thereby allowing the terminal to be released easily and efficiently.

Various changes to the foregoing described and shown structures would now be evident to those skilled in the art. Accordingly, the particularly disclosed scope of the invention is set forth in the following claims.

What is claimed is:

1. A connector comprising terminal, and a housing (10) having slots (12) each for receiving therein said terminal (1), each slot having therein a lance (11) for engaging with and latching said terminal inserted into the slot, wherein a curved surface (1A) is shaped on a part of said terminal in contact with said lance so that said terminal may be released from said lance by externally applying a predetermined force to said terminal in a reverse direction to an insertion direction of said terminal.

2. A connector according to claim 1, wherein said lance has a contact surface at an end portion thereof, said contact portion being in partial contact with said curved surface of said terminal.

3. A connector according to claim 1, wherein said external force is determined in accordance with at least one of a contact angle between the lance and the terminal, a shape of the lance, and the quality or stiffness of material.

4. A connector according to claim 1, wherein a through-hole (13) is formed in said housing (10) and said external force may be applied to said terminal inserted into said slot by means of a tool (20) inserted through the through-hole (13).

5. A connector according to claim 4, wherein said through-hole (13) further comprises a groove (13A) formed on opposed inner wall **(13*b*) of an opening (13B) of said slot (12)** for accommodating therethrough said tool.

* * * * *